US005433602A

United States Patent [19]

Sigler

[11] Patent Number: 5,433,602

[45] Date of Patent: * Jul. 18, 1995

[54] JET BURNER CONSTRUCTION, HEATING APPARATUS UTILIZING THE JET BURNER CONSTRUCTION, AND METHODS OF MAKING THE SAME

[75] Inventor: Kent K. Sigler, Youngwood, Pa.

[73] Assignee: Robertshaw Controls Company, Richmond, Va.

[ * ] Notice: The portion of the term of this patent subsequent to May 31, 2011 has been disclaimed.

[21] Appl. No.: 231,030

[22] Filed: Apr. 22, 1994

Related U.S. Application Data

[62] Division of Ser. No. 7,497, Jan. 22, 1993, Pat. No. 5,316,470.

[51] Int. Cl.[6] ..... F23D 14/58

[52] U.S. Cl. ..... 431/286; 431/354; 29/890.02

[58] Field of Search ..... 431/354, 286; 29/890.02

[56] References Cited

U.S. PATENT DOCUMENTS

| | | | |
|---|---|---|---|
| 2,121,948 | 6/1938 | Borland . | |
| 3,198,238 | 8/1965 | Hughes . | |
| 3,412,940 | 11/1968 | Ferroli . | |
| 3,825,398 | 7/1974 | Katchka et al. | 431/285 X |
| 5,108,284 | 4/1992 | Gruswitz | 431/286 |
| 5,186,620 | 2/1993 | Hollingshead | 431/286 X |
| 5,316,470 | 5/1994 | Sigler | 431/354 X |

FOREIGN PATENT DOCUMENTS

| | | | |
|---|---|---|---|
| 1328641 | 8/1987 | U.S.S.R. | 431/286 |

*Primary Examiner*—Carl D. Price
*Attorney, Agent, or Firm*—Candor, Candor & Tassone

[57] ABSTRACT

A jet burner construction, a heating apparatus utilizing the jet burner construction and methods of making the same are provided, the jet burner construction comprising a burner body having a chamber therein and having an inlet leading to the chamber for directing fuel from a fuel source therein and an outlet leading from the chamber and defining an outlet opening through which the fuel is adapted to issue from the chamber to burn externally to the burner body, the burner construction having an insert disposed in the outlet opening, the insert having a central opening part passing therethrough and a plurality of spaced apart opening portions passing therethrough whereby flows of fuel respectively issuing out of the portions and the central part of the insert merge together in a turbulent manner externally of the outlet opening, the burner body being formed of two generally similar integral and one-piece body sections secured together in superimposed relation and each having generally one-half of the outlet opening thereon, one of the body sections having the insert integral and one-piece therewith.

18 Claims, 3 Drawing Sheets

JET BURNER CONSTRUCTION, HEATING APPARATUS UTILIZING THE JET BURNER CONSTRUCTION, AND METHODS OF MAKING THE SAME

CROSS REFERENCE TO RELATED APPLICATIONS

This application is a divisional patent application of its parent patent application Ser. No. 007,497, filed Jan. 22, 1993, now U.S. Pat. No. 5,316,470.

BACKGROUND OF THE INVENTION

1. Field of the Invention

This invention relates to a new jet burner construction and to a new heating apparatus utilizing such a jet burner construction as well as to new methods of making such a jet burner construction and such a heating apparatus.

2. Prior Art Statement

It is known to provide a jet burner construction comprising a burner body means having a chamber means therein and having an inlet means leading to the chamber means for directing fuel from a fuel source therein and an outlet means leading from the chamber means and defining an outlet opening means through which the fuel is adapted to issue from the chamber means to burn externally to the burner body means, the burner construction having an insert means disposed in the outlet opening means, the insert means having a central opening part passing therethrough and a plurality of spaced apart opening portions passing therethrough whereby flows of fuel respectively issuing out of the portions and the central part of the insert means merge together in a turbulent manner externally of the outlet opening means, the burner body means being formed of two generally similar integral and one-piece body sections secured together in superimposed relation and each having generally one-half of the outlet opening means thereon. For example, see the U.S. patent to Gruswitz, U.S. Pat. No. 5,108,284.

Also see the U.S. patent to Riehl, U.S. Pat. No. 5,035,609 and the U.S. patent to Riehl, U.S. Pat. No. 5,131,839 for similar jet burner constructions which do not utilize insert means therein.

It is also known to extrude the edge means of a burner port beyond the surface means of the wall structure having the burner port formed therein to minimize flashback and provide improved flame retention. For example, see the U.S. patent to Riehl, U.S. Pat. No. 4,951,880.

SUMMARY OF THE INVENTION

It is one of the features of this invention to provide a new jet burner construction that has unique insert means disposed in the outlet opening means thereof for creating turbulence in the flows of fuel respectively issuing out of various port means passing through such insert means.

In particular, it was found according to the teachings of this invention that prior known jet burner constructions that utilize an insert means in the outlet opening means thereof are each relatively costly to manufacture as the same requires a separate insert means to be assembled with the burner body means thereof.

However, it is believed according to the teachings of this invention that a unique insert means can be formed integral and one-piece with one of the two similar body sections that are utilized to form the jet burner construction when the two generally similar integral and one-piece body sections are secured together in superimposed relation.

For example, one embodiment of this invention comprises a jet burner construction comprising a burner body means having a chamber means therein and having an inlet means leading to the chamber means for directing fuel from a fuel source therein and an outlet means leading from the chamber means and defining an outlet opening means through which the fuel is adapted to issue from the chamber means to burn externally to the burner body means, the burner construction having an insert means disposed in the outlet opening means, the insert means having a central opening part passing therethrough and a plurality of spaced apart opening portions passing therethrough whereby flows of fuel respectively issuing out of the portions and the central part of the insert means merge together in a turbulent manner externally of the outlet opening means, the burner body means being formed of two generally similar integral and one-piece body sections secured together in superimposed relation and each having generally one-half of the outlet opening means thereon, one of the body sections having the insert means integral and one-piece therewith.

Accordingly, it is an object of this invention to provide a new jet burner construction having one or more of the novel features of this invention as set forth above or hereinafter shown or described.

Another object of this invention is to provide a new method of making such a jet burner construction, the method of this invention having one or more of the novel features of this invention as set forth above or hereinafter shown or described.

Another object of this invention is to provide a new heating apparatus utilizing such a jet burner construction, the heating apparatus of this invention having one or more of the novel features of this invention as set forth above or hereinafter shown or described.

Another object of this invention is to provide a new method of making such a heating apparatus, the method of this invention having one or more of the novel features of this invention as set forth above or hereinafter shown or described.

Other objects, uses and advantages of this invention are apparent from a reading of this description which proceeds with reference to the accompanying drawings forming a part thereof and where in:

DESCRIPTION OF THE PREFERRED EMBODIMENTS

Figure 1:
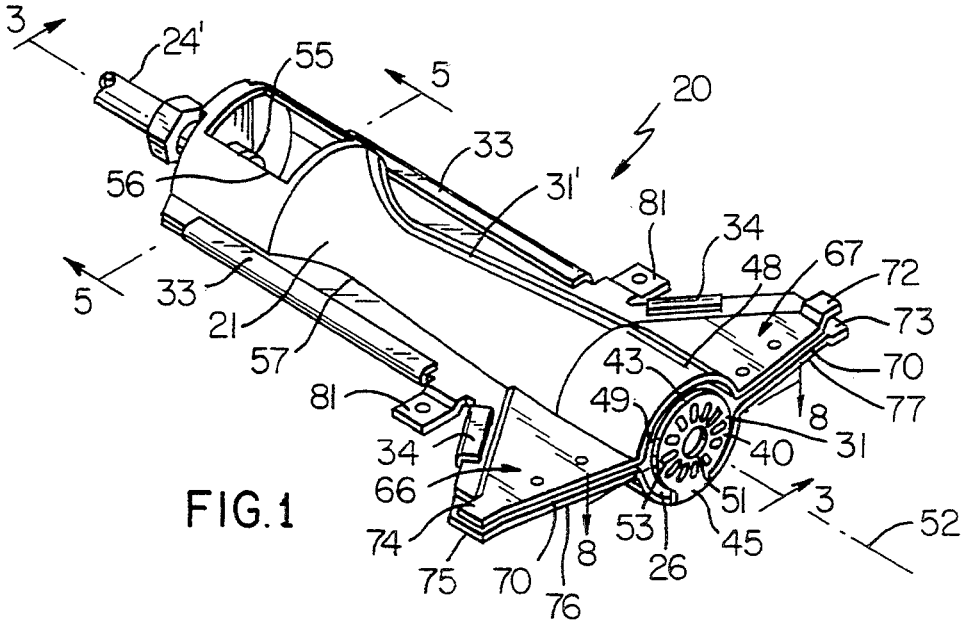
FIG. 1 is a perspective view of the new jet burner construction of this invention.

While the various features of this invention are hereinafter illustrated and described as being particularly adapted to provide a burner construction for a jet burner construction application thereof, it is to be understood that the various features of this invention can be utilized singly or in various combinations thereof to provide a burner construction for other apparatus as desired.

Therefore, this invention is not to be limited to only the embodiments illustrated in the drawings, because the drawings are merely utilized to illustrate one of the wide variety of uses of this invention.

Figure 2:
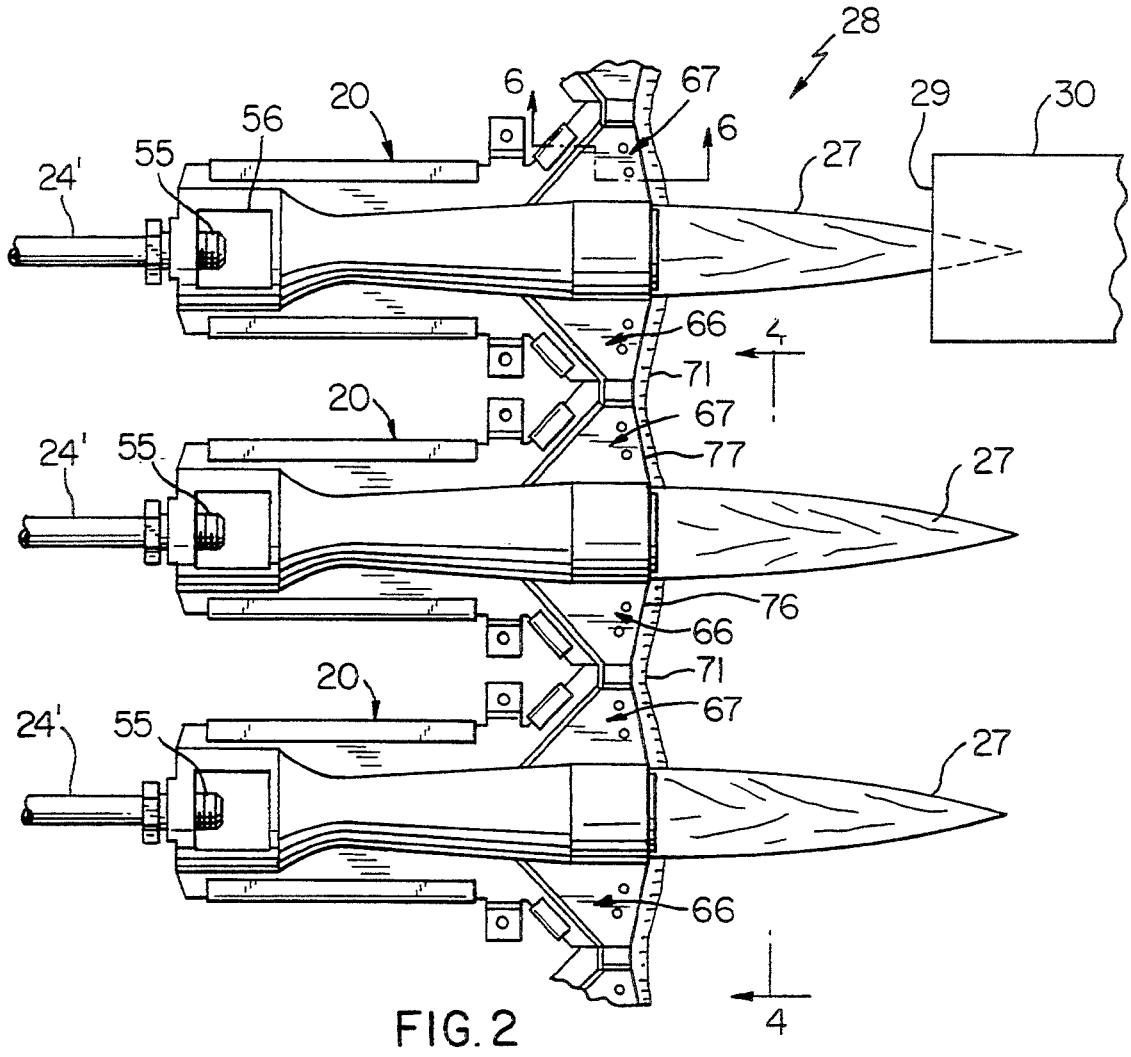
FIG. 2 is a fragmentary top view of a plurality of the jet burner constructions of FIG. 1 arranged in a heating apparatus of this invention.
Figure 3:
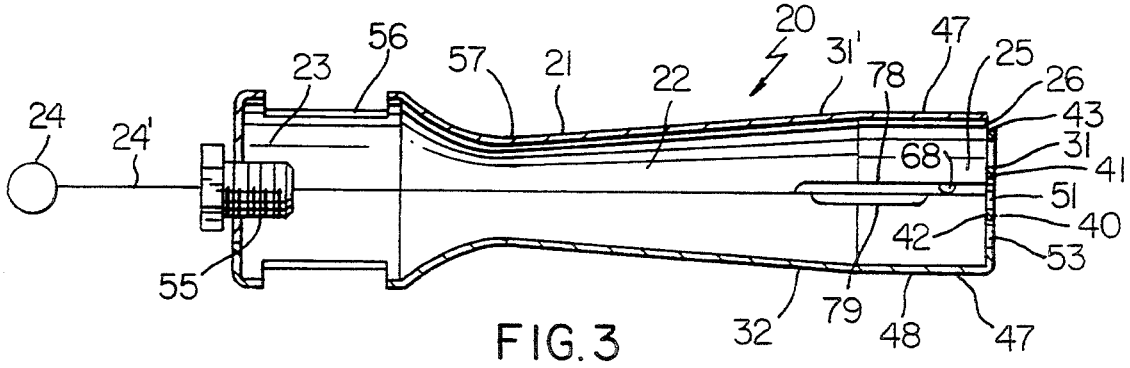
FIG. 3 is a cross-sectional view taken on line 3—3 of FIG. 1.

Referring now to FIGS. 1, 2 and 3, the new jet burner construction of this invention is generally indicated by the reference numeral 20 and comprises a burner body means 21 having a chamber means 22 therein and having an inlet means 23 leading to the chamber means 22 for directing fuel, such as a natural or synthetic gas, from a fuel source 24 and an outlet means 25 leading from the chamber means 22 and defining an outlet opening means 26 through which the fuel is adapted to issue from the chamber means 22 to burn externally to the burner body means 21 as illustrated by the flames 27 in FIG. 2.

Figure 4:
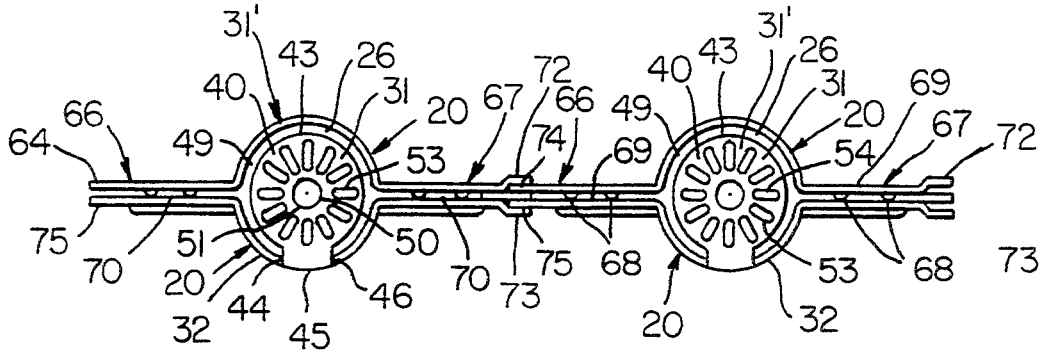
FIG. 4 is a fragmentary end view taken in the direction of the arrows 4—4 of FIG. 2 and illustrates the outlet ends of two of the jet burner constructions of this invention without having the fuel burning at the outlet ends thereof as illustrated in FIG. 2.

The jet burner construction 20 of this invention is adapted to be arranged in a side-by-side aligned relation with a plurality of other jet burner constructions 20 of this invention in the manner illustrated in FIGS. 2 and 4 to be utilized in a heating apparatus of this invention that is generally indicated by the reference numeral 28 in FIG. 2 wherein each jet burner construction 20 is adapted to direct its flame 27 into an inlet end 29 of a heat tube arrangement 30 which extracts heat from the flame 27 in an efficient manner that is well known in the art. For example, see the Bryant Formula 1,000 heating apparatus of the Carrier Corporation of Syracuse, N.Y. Therefore, further details of the structure and of the operation of the heating apparatus 28 need not be set forth.

Also, the burner construction 20 and the apparatus 28 of this invention are generally the same as the burner constructions and the apparatus of the aforementioned U. S. patents to Riehl, U.S. Pat. Nos. 5,035,609 and 5,131,839, whereby these two U.S. patents are being incorporated into this disclosure by this reference thereto.

However, as previously stated, the burner construction 20 of this invention has a unique insert means 31 disposed in the outlet opening means 26 of the burner body means 21 to control the flow of fuel out of the burner body means 21 in a manner similar to other jet burner constructions that have insert means disposed therein. For example, see the aforementioned U.S. patent to Gruswitz, U.S. Pat. No. 5,108,284 whereby this U.S. patent is also being incorporated into this disclosure by this reference thereto.

Figure 7:
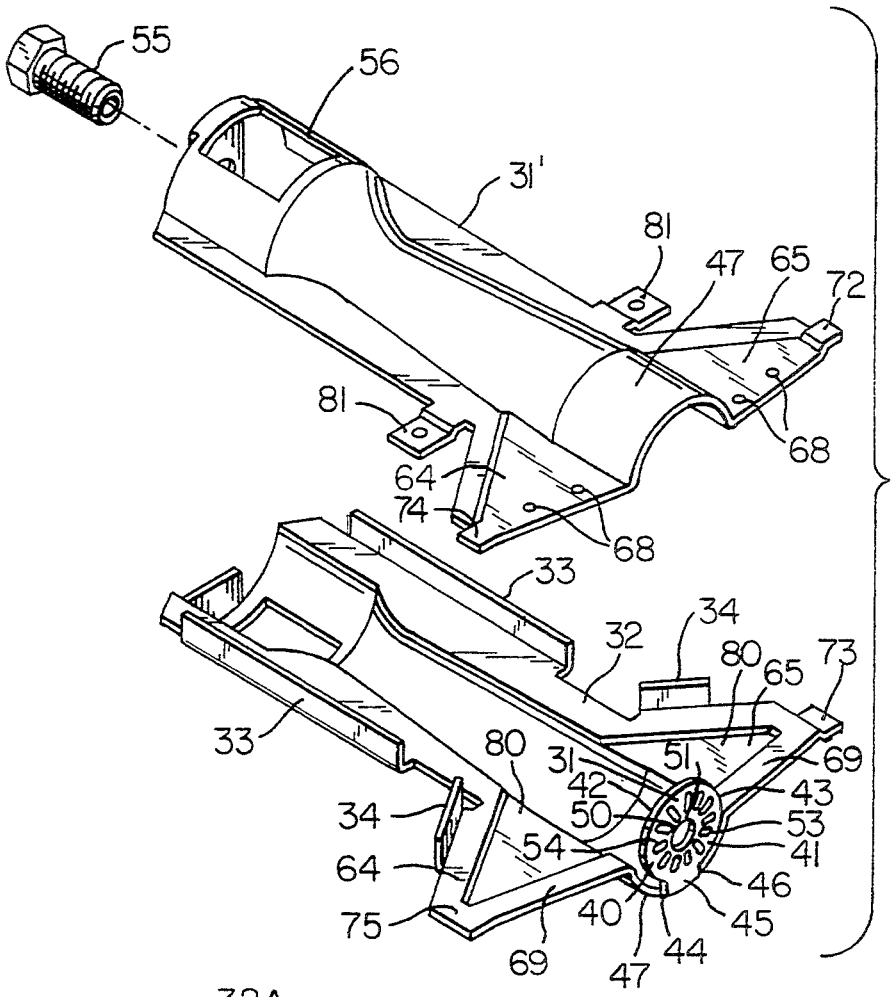
FIG. 7 is an exploded perspective view of the various parts for forming the jet burner construction of FIG. 1.

The jet burner construction 20 of this invention has the burner body means 21 thereof formed from two substantially similar sheet metal plates or body sections 31′ and 32, FIG. 7, that have been suitably stamped, cut and shaped in the configurations illustrated in the drawings so that when the plates 31′ and 32 are disposed together in face-to-face relation, flange means 33 and 34 of the plate means 32 can be folded over against the plate means 31′ in the manner illustrated in FIG. 1 to seal the plates 31′ and 32 together whereby the two plate means 31′ and 32 readily form the body means 21 of the burner construction 20 of this invention in substantially the same manner as set forth in the aforementioned U.S. patents to Riehl, U.S. Pat. Nos. 5,035,609 and 5,131,839.

As set forth in one working embodiment of the jet burner construction of the aforementioned patents to Riehl, the burner body plate means or sections are each formed from an aluminized steel strip RMS-421 that is approximately 0.035 of an inch thick with the resulting burner body means being approximately 5.000 inches in length. It is believed that the burner construction 20 of this invention can be formed of the same material and have substantially the same dimensions as set forth in such patents to Riehl.

Figure 12:
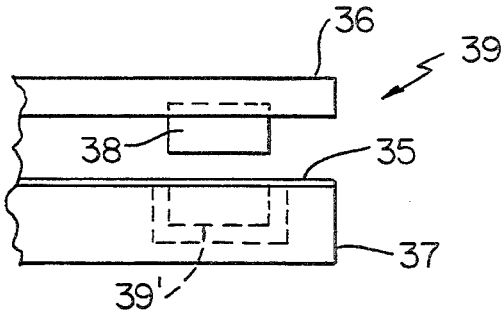
FIG. 12 is a fragmentary side view schematically illustrating the die means for forming one of the burner body sections of FIG. 7 for forming the burner construction of FIG. 1.

Each plate means or body section 31′ or 32 of the burner construction 20 of this invention can be formed from a substantially flat, integral and one-piece sheet 35 of metallic material that is adapted to be formed into the desired shape by a pair of die means 36 and 37 schematically illustrated in FIG. 12 with the die means 36 and 37 respectively having removable cooperating die parts 38 and 39′ for respectively shaping the insert means 31 on the plate means 32 as the insert means 31 is integral and one-piece with the plate means 32 as will be apparent hereinafter.

Therefore, it can be seen in FIG. 12 that an apparatus of this invention is generally indicated by the reference numeral 39 for forming the sheet 35 into the plate means 32 and that the removable die means 38 and 39′ can be replaced with other die means so as to form an insert means on the resulting plate means 32 that has a different desired configuration than the configuration of the insert means 31 illustrated in the drawings whereby burner constructions 20 of this invention can be formed having different insert means for different applications thereof while the rest of the burner body means 21 thereof will be substantially the same and only the configuration of the insert means 31 will have been changed in a simple and effective manner. Of course, when the apparatus 39 is being used to form a sheet 35 into the burner body section 31′, the die parts 38 and 39′ are not used.

The particular insert means 31 illustrated in the drawings comprises a substantially flat disc-like member 40 having opposed flat parallel sides 41 and 42 and an outer peripheral edge means 43 interconnecting the sides 41 and 42 together and being generally circular in configuration as the edge means 43 extends from one side 44 of an integral hinge means or tab 45 to the other side 46 thereof.

The hinge or tab 45 of the disc-like member 40 joins with a cylindrical forming portion 47 of the plate means 32 which cooperates with a like portion 47 of the plate means 31 to define a substantially cylindrical section 48 of the burner body means 21 which defines the outlet opening means 26 thereof as also being a substantially circular configuration which is spaced concentrically about the peripheral edge means 43 of the disc-like member 40 to define an arcuate slot 49 therebetween out of which fuel can flow from the chamber means 22 of the burner body means 21.

In addition, the disc-like member 40 has an inner peripheral edge means 50 defining a central part or opening 51 through the disc-like member 40, the inner peripheral edge means 50 also defining a circular configuration that is concentrically disposed within the outer peripheral edge means 43 as illustrated in FIG. 1 and is coaxial with an axis 52 of the burner body means 21 as illustrated in FIG. 1.

The disc-like member 40 has a plurality of elongated ports or opening portions 53 disposed in a circular array intermediate the inner peripheral edge means 50 and the outer peripheral edge means 43 and spaced therefrom with each portion 53 being defined by a peripheral edge means 54 thereof and being substantially radially disposed relative to the longitudinal axis 52 so as to provide for fuel flow therethrough from the chamber means 22 to the exterior of the burner body means 21.

Therefore, it can be seen that when fuel from the fuel source 24 enters the inlet means 23 of the chamber means 22 by being interconnected by suitable conduit means 24' to an orifice means 55 carried by the burner body means 21, the flow of fuel draws primary air through suitable opening means 56 formed in the burner body means 21 adjacent the inlet means 23 as the fuel air mixture passes through a venturi means 57 of the burner body means 21 to issue out of the opening means 26 by passing through the slot means 49, through the central part 50 of the insert means 31 and through the opening portions 53 of the insert means 31 to mix together in a turbulent manner and produce a flame means 27 for entering its respective heating tube 30 as illustrated in FIG. 2. The reasons for the turbulent mixing of the individual flows of fuel out through the opening parts 49, 50 and 53 being fully discussed in the aforementioned U.S. patent to Riehl, U.S. Pat. No. 5,035,609 and need not be further described.

Therefore, it can be seen that it is a relatively simple method of this invention to provide a unique insert means 31 that is integral and one-piece with an integral and one-piece body section 32 that cooperates with a similar body section 31' to form the burner body means 21, the insert means 31 either being disposed substantially at a right angle relative to the main plane of the burner body section 32 or being bent into such right angled relationship after the sections 31' and 32 have been assembled together, as desired.

Further, it can be seen that the particular configuration of the various fuel flow opening means provided by the insert means 31 of this invention in cooperation with the burner body sections 31' and 32 can be readily changed to any desired configurations by merely changing the die sections 38 and 39' of the main dies 36 and 37 when producing the body section 32 for the reasons previously set forth.

Other features of the burner construction 20 of this invention are substantially similar to such features of the burner constructions of the aforementioned U.S. patents to Riehl, U.S. Pat. Nos. 5,035,609 and 5,131,839, whereby such structure will now be just generally described as the specific details of the structure and the operation thereof is now well known in the art.

The body sections of plates 31' and 32 that form the burner body means 21 each has a pair of wing-like extensions 64 and 65 extending outwardly therefrom in a coplaner manner so that when the formed plates or body sections 31' and 32 are secured together by the folded over flange means 33 and 34 to form the burner body means 21, the cooperating extensions 64 and 65 define wing-like extensions that are generally indicated by the reference numerals 66 and 67 and extend from opposed sides of the burner body means 21 adjacent the outlet end means 25 thereof.

The wing-like extensions 34 and 35 of the plate 31' are respectively stepped upwardly as illustrated and have a plurality of dimples 68 formed therein to respectively engage against the surfaces 69 of the wing-like extensions 64 and 65 of the other plate 32 so as to space the facing surfaces 69 of the cooperating pairs of wing-like structures 64 and 65 from each other to define a fuel-issuing slot means 70 there-between that respectively interconnect to the chamber means 22 and the outlet opening 26 so that fuel can issue from the slot means 70 of the wing-like extensions 66 and 67 to define front end carry-over ignition flame means 71 as illustrated in FIG. 2 for multiple burner ignition propagation purposes in the apparatus 28 in a manner well known in the art so that only ignition structure (not shown) need be provided for one of the jet burner constructions 20 in the apparatus 28 and the other burner constructions 20 will be ignited therefrom in a series manner as is well known in the art.

However, in order to prevent delayed ignition due to poor alignment of the burner constructions 20, the wing-like extension 65 of the plate 31' and the wing-like extension 65 of the plate 32 of each burner body means 21 are respectively provided with tabs 72 and 73 which are disposed or stepped out of the plane of the respective wing-like extensions 65 so as to provide the overlapping leg arrangement with non-stepped tabs 74 and 75 of the adjacent burner construction 20 as illustrated in FIGS. 2 and 4 when the jet burner constructions 20 are arranged in aligned relation as illustrated.

The slots 70 of the wing-like extensions 66 and 67 of the burner construction 20 extend respectively along the entire respective leading edge means 76 and 77 thereof as illustrated in FIG. 2 and through which the carry-over flames 71 can issue as the same are being fed fuel from the chamber means 22 at a point downstream from the venturi section 57 and then out between spaced edge means 78 and 79 of the respective wing-like sections 66 and 67 as illustrated in FIG. 3.

Figure 6:
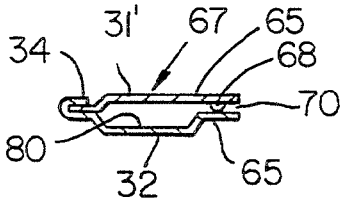
FIG. 6 is a fragmentary cross-sectional view taken on line 6—6 of FIG. 2.
Figure 5:
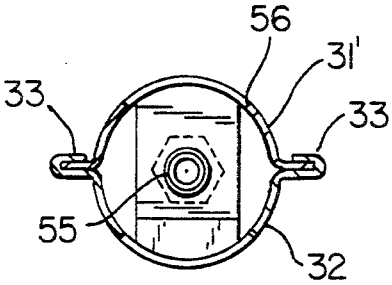
FIG. 5 is a cross-sectional view taken on line 5—5 of FIG. 1.

If desired, the wing-like extensions 64 and 65 on the lower body section or plate 32 of each burner construction 20 can have substantially triangular-shaped portions 80 formed therein by being stepped downwardly from the normal plane of the wing-like sections 64 and 65 so as to provide sufficient fuel to issue out of the outlet slots 70 in the manner illustrated in FIG. 6 and for the reasons fully set forth in the aforementioned U. S. patent to Riehl, U.S. Pat. No. 5,131,839.

Therefore, it can be seen that the burner construction 20 of this invention is formed from two similar body sections 31' and 32 that are disposed in superimposed relation and have the insert means 31 being integral and one-piece with the body section 32 to provide for fuel control of the fuel issuing out of the outlet opening means 26 of the respective burner body means 21, the plate 31' of the burner body means 21 having suitable mounting tabs 81 extending outwardly-therefrom so as to permit the burner body means to be mounted to any suitable structure (not shown) in the aligned relation illustrated in FIG. 2 for the heating apparatus 28 or for other apparatus as desired.

While the insert means 31 of this invention has the same thickness as the sheet which is utilized to form the burner body section 32 in the manner previously described, the insert means 31 can be provided with structure that extends beyond one of both sides 41 and 42 thereof to control flame retention and prevent flashback problems for the reasons fully set forth in the aforementioned U. S. patent to Riehl, U.S. Pat. No. 4,951,880, whereby this U.S. patent is also being incorporated into this disclosure by this reference thereto.

Figure 8:
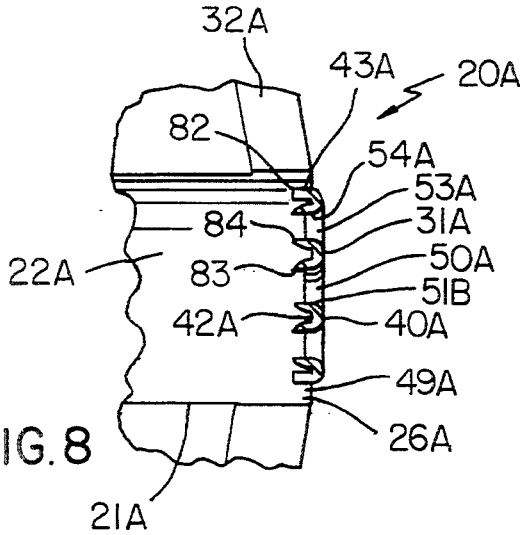
FIG. 8 illustrates another jet burner construction of this invention and is the same as if a fragmentary cross-sectional view was taken on line 8—8 of FIG. 1.

For example, reference is now made to FIG. 8 wherein another burner construction of this invention is generally indicated by the reference numeral 20A and parts thereof similar to the parts of the burner construction 20 previously described are indicated by like reference numerals followed by the reference letter "A".

As illustrated in FIG. 8, it can be seen that the insert means 31A comprises the disc-like member 40A previously described except that the same has the outer peripheral edge means 43A thereof provided with tab-like structure 82 extending rearwardly from the side 42A thereof and thus into the chamber means 22A of the burner body means 21A to cooperate with the outlet opening means 26A in defining the arcuate outlet slot 49A. Similarly, the central part 50A has structure 83 extending in a tab-like manner beyond the side 42A at the peripheral edge means 51A thereof. Likewise, each opening portion 53A has structure 84 extending in a tab-like manner beyond the side 42A of the insert means 31A completely around the peripheral edge means 54A thereof whereby it can be seen that the structures 82, 83 and 84 provide relatively long flame retention structure for the flows of fuel that are respectively passing out of the opening means 49A, 50A and 53A not only for the reasons set forth in the U.S. patent to Riehl, U.S. Pat. No. 4,951,880, but also for the reasons set forth in the aforementioned U.S. patent to Gruswitz, U.S. Pat. No. 5,108,284.

The structures 82, 83 and 84 can be formed in any suitable manner, such as by being bent or drawn and ironed from the member 40A as the insert means 31A is being formed by the die means 38 and 39' of the apparatus 28 in a manner similar to the apparatus set forth in the aforementioned U.S. patent to Riehl, U.S. Pat. No. 4,951,880.

While the insert means 31 and 31A previously described comprise substantially flat disc-like sections 40 and 40A, it is to be understood that the same could be shaped other than flat as desired.

Figure 9:
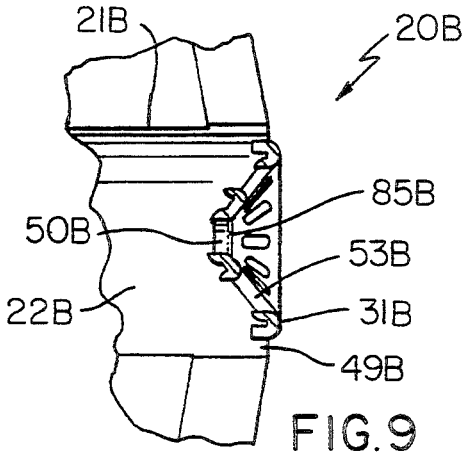
FIG. 9 is a view similar to FIG. 8 and illustrates another jet burner construction of this invention.

For example, another burner construction of this invention is generally indicated by the reference numeral 20B in FIG. 9 and parts thereof similar to the parts of the burner constructions 20 and 20A previously described are indicated by like reference numerals followed by the reference letter "B".

As illustrated in FIG. 9, the insert means 31B for the burner construction 20B is substantially the same as the insert means 31A previously described except that the disc-like member 40B has been shaped to be substantially conical as illustrated in FIG. 9 so that the apex 85 of the conical shape will extend into the chamber means 22B of the burner body means 21B so as to provide for an unique control of the flows of fuel out of the opening means 49B, 50B and 53B as illustrated. Of course, the conical shape could have the apex 85 pointing outwardly rather than inwardly into the chamber 22B if desired.

Further, it may be found that it is desired to fasten the non-hinged edge of the insert means 31, 31A or 31B of this invention in place so the same cannot be accidentally bent out of the desired location for the respective insert means 31, 31A or 31B relative to its respective outlet opening 26, 26A, or 26B.

Figure 10:
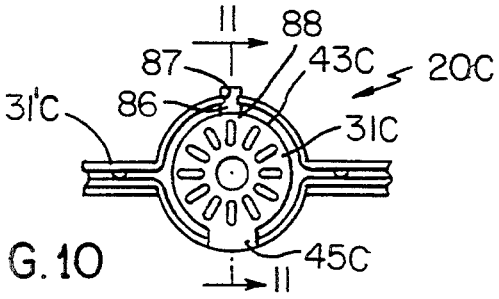
FIG. 10 is a fragmentary front view of another jet burner construction of this invention.
Figure 11:
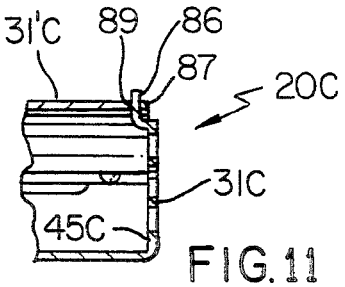
FIG. 11 is a fragmentary cross-sectional view taken on line 11—11 of FIG. 10.

For example, reference is now made to FIGS. 10 and 11 wherein another burner construction of this invention is generally indicated by the reference numeral 20C and parts thereof similar to the parts of the burner constructions 20, 20A and 20B previously described are indicated by like reference numerals followed by the reference letter "C".

As illustrated in FIGS. 10 and 11, the insert means 31C has a small integral tab 86 extending from the peripheral edge means 43C thereof directly opposite the hinge portion 45C thereof, the tab 86 being adapted to be snap-fitted into a slot 87 formed in the burner body section 31'C so as to be disposed behind edge means 88 of the burner body means 31'C and held against a shoulder means 89 thereof as illustrated in FIGS. 10 and 11 to positively hold the insert means 31C in a desired position relative to its hinged section 45C as illustrated.

Therefore, it can be seen that the insert means of this invention can be changed to any desired configuration thereof to cooperate with the remaining structure of the burner body means to produce various flows of fuel issuing therefrom as previously described.

Accordingly, this invention not only provides a new jet burner construction and a new method of making the same, but also, this invention provides a new heating apparatus utilizing such a jet burner construction and a new method of making such a heating apparatus.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means, said burner construction having an insert means disposed in said outlet opening means, said insert means having a central opening part passing therethrough and a plurality of spaced apart opening portions passing therethrough whereby flows of fuel respectively issuing out of said portions and said central part of said insert means merge together in a turbulent manner externally of said outlet opening means, said burner body means being formed of two generally similar integral and one-piece body sections secured together in superimposed relation and each having generally one-half of said outlet opening means thereon, the improvement wherein one of said body sections has said insert means integral and one-piece therewith and wherein said insert means is generally conical in configuration.

2. A jet burner construction as set forth in claim 1 wherein said insert means has a portion thereof that hinges said insert means to its respective said one of said body sections.

3. A jet burner construction as set forth in claim 2 wherein each of said body sections is formed from a sheet of material having substantially a uniform thickness throughout the entire surface area thereof.

4. A jet burner construction as set forth in claim 3 wherein said insert means comprises a disc-like member hinged to said one of said body sections by said portion thereof.

5. A jet burner construction as set forth in claim 4 wherein said portion of said insert means has opposed sides, said disc-like member having an outer peripheral edge means extending from one of said sides of said portion to the other of said sides of said portion.

6. A jet burner construction as set forth in claim 5 wherein said outlet opening means of said burner construction defines a certain configuration, said outer peripheral edge means of said disc-like member also generally defining said certain configuration.

7. A jet burner construction as set forth in claim 6 wherein said peripheral edge means of said disc-like member cooperates with said outlet opening means to define an opening section therebetween whereby a flow of fuel issuing out of said opening section merges with said flows of fuel issuing out of said portions and said central part of said insert means.

8. A jet burner construction as set forth in claim 7 wherein said opening section defines a generally circular configuration.

9. A jet burner construction as set forth in claim 7 wherein said disc-like member has opposed surface means, said outer peripheral edge means defining structure thereof that extends beyond said surface means in a tab-like manner.

10. A jet burner construction as set forth in claim 5 wherein said central part of said insert means defines an inner peripheral edge means of said disc-like member.

11. A jet burner construction as set forth in claim 10 wherein said inner peripheral edge means defines a generally circular configuration.

12. A jet burner construction as set forth in claim 11 wherein said disc-like member has opposed surface means, said inner peripheral edge means defining structure that extends beyond said surface means in a tab-like manner.

13. A jet burner construction as set forth in claim 10 wherein said opening portions of said insert means are each disposed spaced from and intermediate said outer peripheral edge means and said inner peripheral edge means.

14. A jet burner construction as set forth in claim 13 wherein said disc-like member has opposed surface means, each said opening portion of said insert means having peripheral edge means defining the same, said peripheral edge means of each said opening portion extending beyond said surface means in a tab-like manner.

15. A jet burner construction as set forth in claim 13 wherein said opening portions of said insert means are disposed in a circular array about said central part of said insert means.

16. A jet burner construction as set forth in claim 1 wherein said burner body means has wing-like extensions respectively disposed on opposite sides thereof for respectively interconnecting with adjacent wing-like extensions of adjacent burner constructions, each body section having generally one-half of said wing-like extensions thereon.

17. A jet burner construction as set forth in claim 16 wherein said wing-like extensions each has an elongated outlet slot means interconnecting with said outlet opening means and through which fuel is adapted to issue so as to burn external to said wing-like extensions.

18. In a method of making a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means, said burner construction having an insert means disposed in said outlet opening means, said insert means having a central opening part passing therethrough and a plurality of spaced apart opening portions passing therethrough whereby flows of fuel respectively issuing out of said portions and said central part of said insert means merge together in a turbulent manner externally of said outlet opening means, said burner body means being formed of two generally similar integral and one-piece body sections secured together in superimposed relation and each having generally one-half of said outlet opening means thereon, the improvement comprising the steps of forming one of said body sections to have said insert means integral and one-piece therewith, and forming said insert means to be generally conical in configuration.

* * * * *